United States Patent [19]

Blair

[11] 4,055,267

[45] Oct. 25, 1977

[54] CAP FOR A WIDEMOUTHED CONTAINER

[76] Inventor: Richard L. Blair, 249 Mattson Ave., Los Gatos, Calif. 95030

[21] Appl. No.: 722,483

[22] Filed: Sept. 13, 1976

[51] Int. Cl.[2] ..... B65D 41/48

[52] U.S. Cl. ..... 215/254; 215/31

[58] Field of Search ..... 215/253, 254, 256, 320, 215/321

[56] References Cited

U.S. PATENT DOCUMENTS

| | | | |
|---|---|---|---|
| 2,778,520 | 1/1957 | Hyde | 215/305 X |
| 3,301,426 | 1/1967 | Kavalus | 215/254 |
| 3,392,862 | 7/1968 | Faulstich | 215/254 |
| 3,608,765 | 9/1971 | Faulstich | 215/256 |
| 3,622,028 | 11/1971 | Lohrer | 215/253 |
| 3,866,783 | 2/1975 | Bullock | 215/254 |
| 3,940,004 | 2/1976 | Faulstich | 215/320 X |
| 3,985,255 | 10/1976 | Blair | 215/254 |

*Primary Examiner*—Donald F. Norton
*Attorney, Agent, or Firm*—Eckhoff, Hoppe, Slick, Mitchell & Anderson

[57] ABSTRACT

A flexible cap is provided as a closure for a wide-mouthed jar of glass or plastic. Such jars are commonly used for the packaging of viscous materials such as peanut butter, mayonnaise, jams, jellies and the like. The jar mouth is commonly quite wide, of the order of 110 millimeters or more.

1 Claim, 4 Drawing Figures

CAP FOR A WIDEMOUTHED CONTAINER

BACKGROUND OF THE INVENTION

Widemouth jars have commonly been used heretofore but the closure has usually been made of metal and provided with a screw thread. Being made of metal, such a cover must be lined with a material which will protect the metal against attack by the material packaged in the jar. Of necessity, this makes the closure relatively expensive and its placement and attachment to the jar provides special problems.

SUMMARY OF THE INVENTION

It is in general the broad object of the present invention to provide a novel form of plastic cap or closure for a widemouthed jar.

A further object of the invention is to provide a closure for a widemouthed jar which can be placed automatically in position on the mouth of the jar to seal the jar effectively until it is desired to obtain access to the jar contents.

DESCRIPTION OF THE PREFERRED EMBODIMENT

Figure 1:
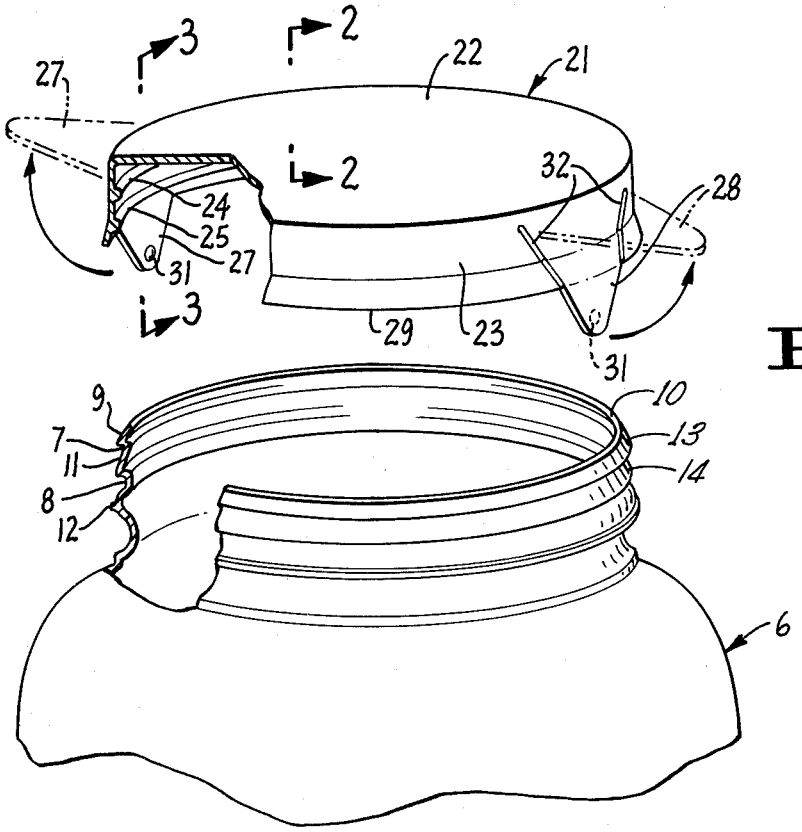
FIG. 1 is a perspective view of a portion of a cap and a widemouthed jar broken away to illustrate the construction.
Figure 2:
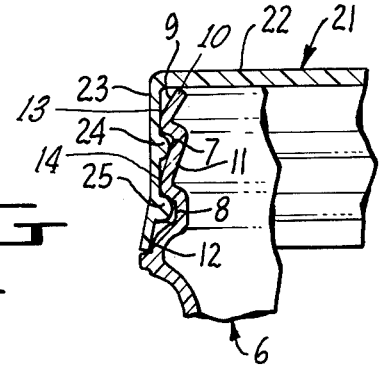
FIGS. 2 and 3 are sections taken along the lines 2-2 and 3-3 in FIG. 1.
Figure 4:
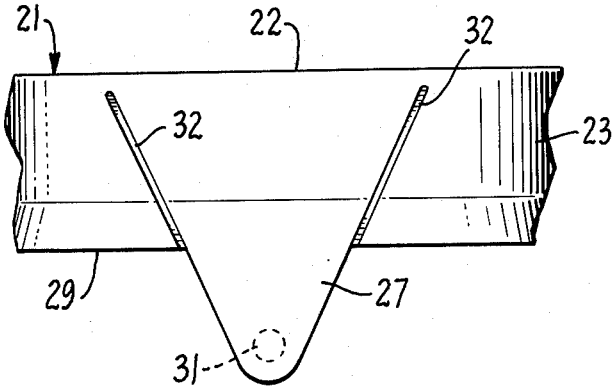
FIG. 4 is a fragmentary view in side elevation looking at the side of the cap shown in FIG. 3.
Figure 3:
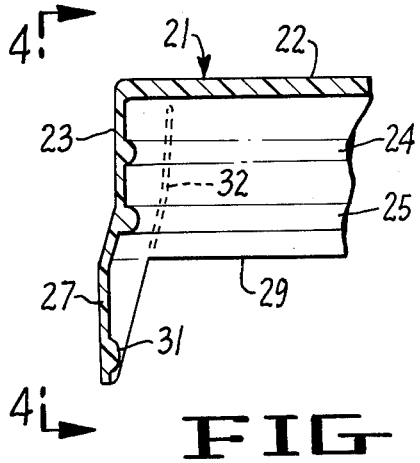

Referring to the drawings, a widemouthed jar is generally indicated at 6. The mouth of the jar is circular and is defined by an annular end with a substantially circular upper corner 10, and has a plurality of spaced circumferential recesses, shown in the preferred embodiment as comprising first and second annular recesses 7 and 8, and defined by side walls 9, 11 and 12, each of which slopes outwardly from the mouth of the jar to provide the recesses or grooves 7 and 8, and defining shoulders or ledges 13 and 14, wherein the upper ledge 13 comprises a minimum diameter portion.

The mouth of the jar is closed by a cap, generally indicated at 21, having a flat top 22 and a downwardly depending flat outer wall 23. The flat outer wall 23 has upper and lower circumferentially extending lips 24 and 25 fitting in the grooves 7 and 8.

On opposite sides of the cap, I provide downwardly extending ears a tabs 27 and 28. Each of the ears is triangular in shape and depends below the lower edge 29 on the side wall 23. At the lower end of each ear, I provide on the inside face thereof an extension 31 which fits against the side of the jar to permit an ear to be grasped readily by fingers and raised, severing the ear along the scorelines 32. The score lines 32 terminate just above the minimum diameter portion 13.

In use, jars are on a conveyor and at a given point in the traverse of the conveyor, the cap is placed over the mouth of the container and forced downwardly to snap into place in a closing position for the container.

I claim:

1. In combination, a container having a neck having an annular end with a substantially circular upper corner and a downward tapering lower curvature ending in a minimum diameter portion, a first and a second annular recess spaced from each other and below said minimum diameter portion; and a cap of a flexible plastic material deformable to accommodate minor variations in bottle dimensions and to permit said cap to stretch over said minimum diameter portion, said cap being preformed and having substantially uniform wall thickness throughout, said cap comprising a flat top disc having a diameter about equal to that of said neck, a depending skirt extending below said minimum diameter portion and having a pair of inwardly extending annular projections each fitting snugly in sealing engagement in one of said annular recesses, and pairs of depending tabs connected to said skirt to extend below said skirt on opposite sides thereof, said skirt being weakened by two pair of score lines extending from each pair of tabs and which are located on the outside surface of said skirt to prevent leakage from the bottle, said score lines being positioned on opposite sides of said tab and extending upwardly toward said flat top disc and diverging outwardly from each other and terminating in the skirt just above said minimum diameter portion and below said corner said skirt being tearable along each pairof score lines to open said cap, said cap in position on said neck sealing said neck against either input or output of any substance, said cap when torn along said score lines permitting removal of said cap from said neck and ready replacement thereof on said neck to reseal said bottle.

* * * * *